United States Patent [19]

Burkert

[11] Patent Number: 4,564,231

[45] Date of Patent: Jan. 14, 1986

[54] APPARATUS FOR THE LIFTING OF COILS, SPOOLS AND THE LIKE

[75] Inventor: Joachim Burkert, Neustadt, Fed. Rep. of Germany

[73] Assignee: Industriewerk Nachf. Seifert & Co. KG, Neustadt, Fed. Rep. of Germany

[21] Appl. No.: 620,404

[22] Filed: Jun. 14, 1984

[30] Foreign Application Priority Data

Jun. 28, 1983 [DE] Fed. Rep. of Germany ..... 3323239

[51] Int. Cl.[4] ..... B66C 1/54

[52] U.S. Cl. ..... 294/96

[58] Field of Search ..... 294/86.24, 86.25, 86.3, 294/93–97; 414/684, 910, 911

[56] References Cited

U.S. PATENT DOCUMENTS

| | | | |
|---|---|---|---|
| 1,489,705 | 4/1924 | Leonard | 294/86.25 X |
| 1,527,130 | 2/1925 | Griffith | 294/86.25 |
| 2,158,814 | 5/1939 | Ashcraft | 294/86.25 |
| 4,057,279 | 11/1977 | Pykala | 294/93 |
| 4,235,469 | 11/1980 | Denny et al. | 294/96 |
| 4,460,210 | 7/1984 | Miechur | 294/97 |

FOREIGN PATENT DOCUMENTS

| | | | |
|---|---|---|---|
| 668952 | 11/1929 | France | 294/93 |
| 674967 | 7/1979 | U.S.S.R. | 294/94 |

*Primary Examiner*—Johnny D. Cherry

*Attorney, Agent, or Firm*—Jordan and Hamburg

[57] ABSTRACT

Apparatus for the lifting of coils, spools and the like of the type which have an interior opening includes a carrying shaft, guide tracks arranged circumferentially about the carrying shaft, and clamping segments disposed on the guide tracks for movement in a radial and a vertical direction, the clamping segments and guide tracks having a cooperable aperture and a cross shaft accommodated in the aperture such that the cross shaft moves in the aperture during relative movement between the guide tracks and the clamping segments. The carrying shaft has an outer conical surface and the clamping segments have an inner conical surface engaging the outer conical surface on the carrying shaft. A locking device is operable to lock the clamping segments into a radially inwardly disposed position such that when the locking device is released, the clamping segments are extended radially outwardly relative to the carrying shaft as the inner conical surface of the carrying segments slide on the carrying shaft to thereby engage the interior opening.

6 Claims, 9 Drawing Figures

APPARATUS FOR THE LIFTING OF COILS, SPOOLS AND THE LIKE

BACKGROUND OF THE INVENTION

This invention relates to an apparatus for the lifting of coils, spools, and the like having a carrying bolt which can be disposed into an inner opening and several clamping segments vertically movable at their outer circumference and thus radially expandable in an outward direction.

Such coils are wound onto the spools of winding machines, then tied and removed from the spool and transported to the site of their further processing. These coils which even in smaller versions often weigh over 100 kg have to be lifted. Here, as well as during the transport thereof, the coils have to be handled as carefully as possible in order not to cause the unwinding during the subsequent processing. It is particularly difficult to transport coils with a comparatively small diameter of the interior opening, since known apparatus is generally too large to be received into such small interior openings of the coils. Known lifting apparatus further more have a complicated construction and are expensive to manufacture, primarily due to the fact that they often serve other purposes in the handling of such coils.

Therefore, there is a need for an apparatus of the initially described type which has a simple construction, is effective when used and which is, above all, suitable for the handling of coils with smaller dimensions of the interior opening. The apparatus according to the invention meets these requirements and has a radially extending concentric guide track at the circumference of a carrying bolt for each clamping segment engaging a longitudinal guide slot of the clamping segment and having at least one tangentially extending crossbolt extending into an oblong aperture in the clamping segment. The crossbolt is arranged transversely to the longitudinal axis with the carrying bolt having an outer cone as a sliding guide for an inner cone of the clamping segments and with the clamping segments having a locking device for the carrying bolt operating in its radial withdrawn and upper position.

Such an apparatus consists of three units, that is, a carrying bolt, a clamping segment mounted thereon, and a locking device. It is therefore simple and inexpensive to manufacture as well as reliable when operated and can, since the clamping segments are mounted immediately around the central carrying bolt, be made with an extremely small external diameter of the clamping segments. It is therefore especially suited for the handling of coils with small diameters of the interior opening.

Additionally, the invention provides for the apparatus to have a bell-shaped top which overlaps the head of the clamping segments from above into which a guiding track engages and which has an inner cone as a sliding guide for an upper outer cone. The bell-shaped top serves as an additional upper guide of the clamping segments during their inward expansion movement so that these are not only guided by their oblong apertures but supported by the bell-shaped top as well.

The external diameter of the bell-shaped top can be larger than the maximum diameter of the clamping segments since, when the apparatus is disposed into the coil to be lifted, only the clamping segments engage in the interior opening of the coil. In this position, the locking device for the clamping segments can be released with respect to the carrying bolt so that the clamping segments drop and are expanded outwardly. During the subsequent lifting of the carrying bolt, the clamping segments firmly engage the inside of the coil opening with the weight of the coil increasing the friction between the clamping segments and the coils in an already-known manner.

According to another characteristic of the invention, a particularly effective locking device consists of concentric pins arranged at the head of each clamping segment and penetrating an opening in the bell-shaped top as well as of a releasable locking bar at the outside of the bell-shaped top engaging into a notch of the pin. If the apparatus has been inserted into the coil, the locking is released and the pins released so that the clamping segments can move into their lowering position.

According to an additional characteristic of the invention, a rotation hood is arranged above the cover plate of the bell-shaped top, rotatably but axially stable on the carrying bolt and having a joint locking bar for the pins of all of the clamping segments. When operating this joint locking bar, all clamping segments are simultaneously locked or released.

It is within the framework of the invention that the head of the clamping segments transcends their outer frictional surfaces radially in an outward direction. This has the advantage that the apparatus can be disposed into this until the clamping segment heads have been mounted on the coil, whereafter the locking for the clamping segments is released. In this simple fashion, the clamping segments form a stop, limiting the movement of the device into the coil.

In an alternate embodiment, the invention provides for a parallel construction with two crossbolts and corresponding oblong apertures between each clamping segment and the corresponding guide track. In this embodiment, the clamping segments are guided in a two fold fashion resulting in an exact guidance of the clamping segments.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

DESCRIPTION OF THE PREFERRED EMBODIMENTS

Figure 1:
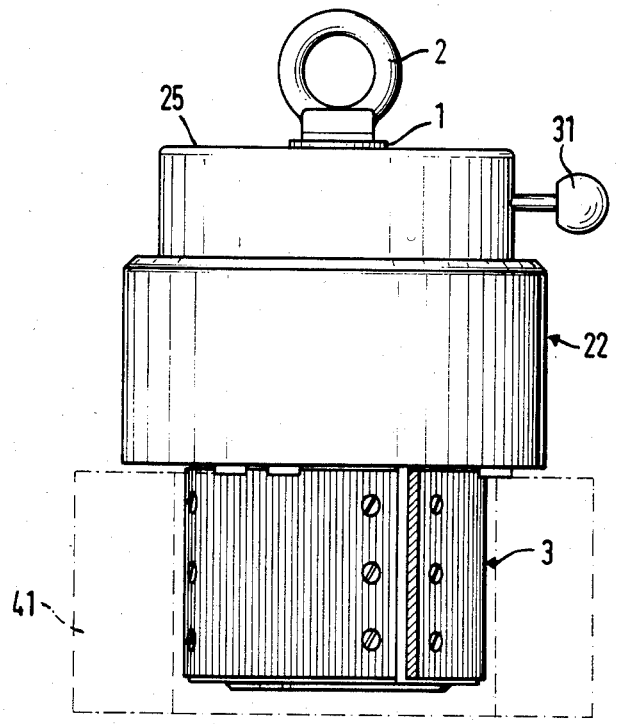
FIG. 1 is a side elevation of the apparatus showing the clamping segments in a withdrawn position.
Figure 2:
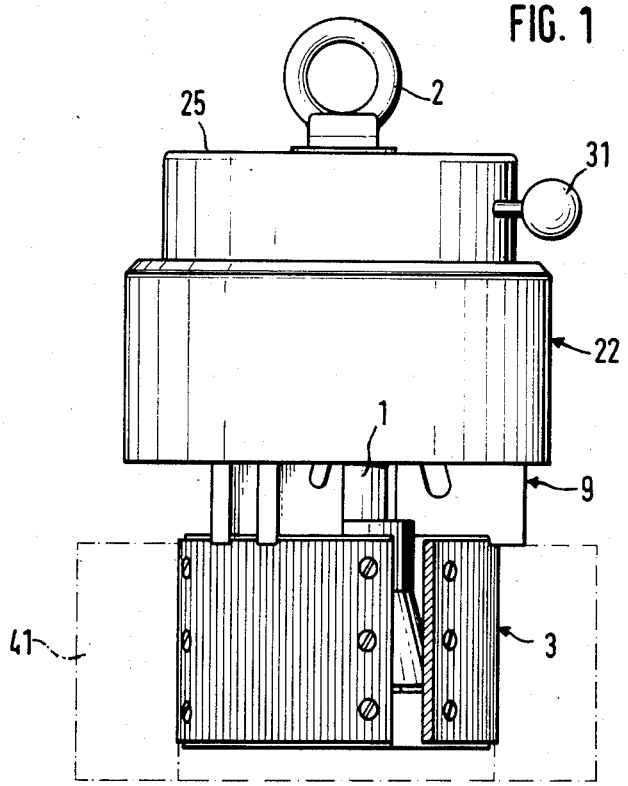
FIG. 2 is a side elevation of the apparatus showing the clamping segments in an extended position.

The apparatus consists of a central carrying bolt 1 with a supporting loop 2 attached to its upper end by means of which the apparatus can be fastened to a lifting apparatus. At the lower part of the carrying bolt 1, in the illustrated embodiment having three clamping segments 3, three guide tracks 4 are arranged concentrically with the head 5 thereof being spaced from the wall 6 of the bolt 1. The guide tracks 4 are spaced 120° apart around the central carrying bolt 1. At its lower end 7 the carrying bolt 1 has an outer cone 8 in the space between the guide tracks 4.

Each guide track 4 supports a clamping segment 3. A carrier 9 of the clamping segment 3 has a longitudinal guide slot 10 which is bridged by the crossbar 13 connecting two parts 11 and 12 of the carrier 9. The head 14 of the carrier 9 has an oblong aperture 15, the longitudinal axis of which converges towards the upper end of the carrying bolt 1. The extent of the convergence corresponds to the angle of inclination of the cone 8 of the carrying bolt 1. The ends of a crossbolt 16 are fastened in the head 5 of the guide track 4 and extend into the oblong apertures 15 of the two parts 11 and 12 of the clamping segment carrier 9. At the lower end of the carrier 9, there is an inner cone 17 adjacent to the outer cone 8 of the carrying bolt 1. The outer circumference 20 of the crossbar 13 is conically formed in correspondence with the angle of inclination of the cone 8 and the convergence angle of the oblong apertures 15. This outer cone is adjacent to the inner cone 21 of a bell-shaped top 22 which overlaps the head 5 of the guide track 4 and the head 14 of the clamping segment carriers 9. The two cones 20 and 21 form an upper sliding guide for the clamping segments 3, and the cones 8 and 17 form a lower sliding guide for the central carrying bolt 1.

Figure 5:
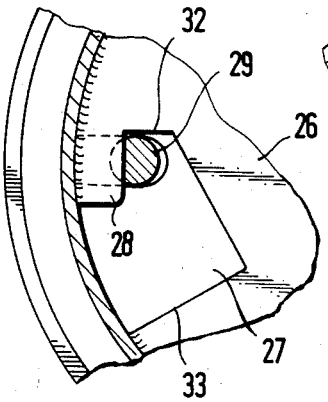
FIG. 5 is a sectional view taken along the line V—V in FIG. 6.
Figure 3:
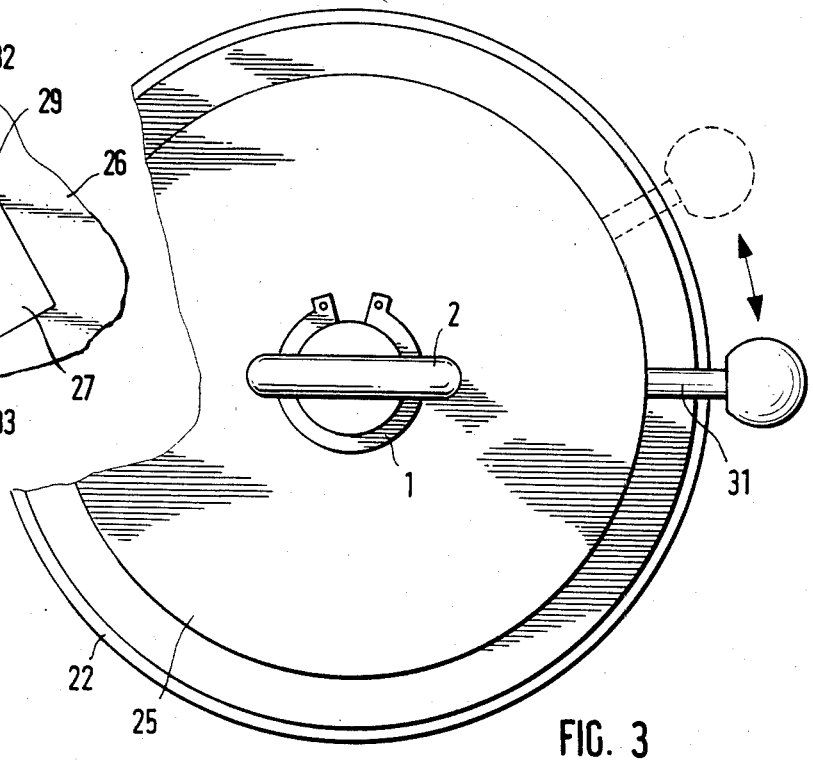
FIG. 3 is a plan view of the apparatus.
Figure 4:
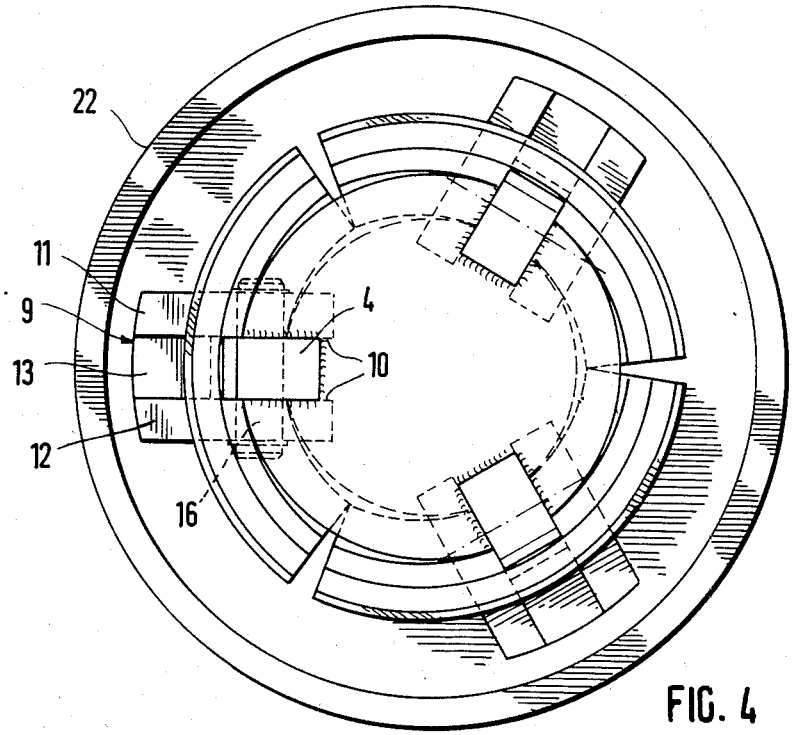
FIG. 4 is a bottom view of the apparatus in its position according to FIG. 1.
Figure 7:
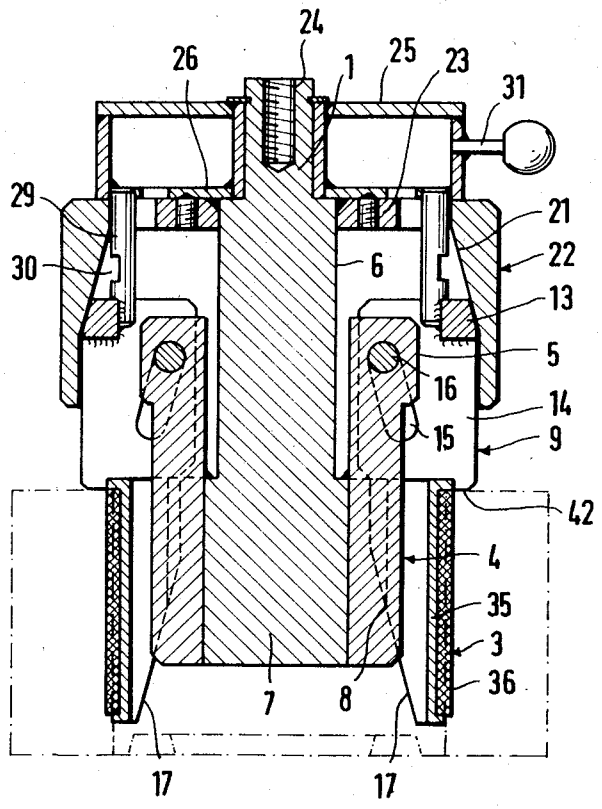
FIG. 7 is a vertical sectional view through the apparatus in its position according to FIG. 2.
Figure 6:
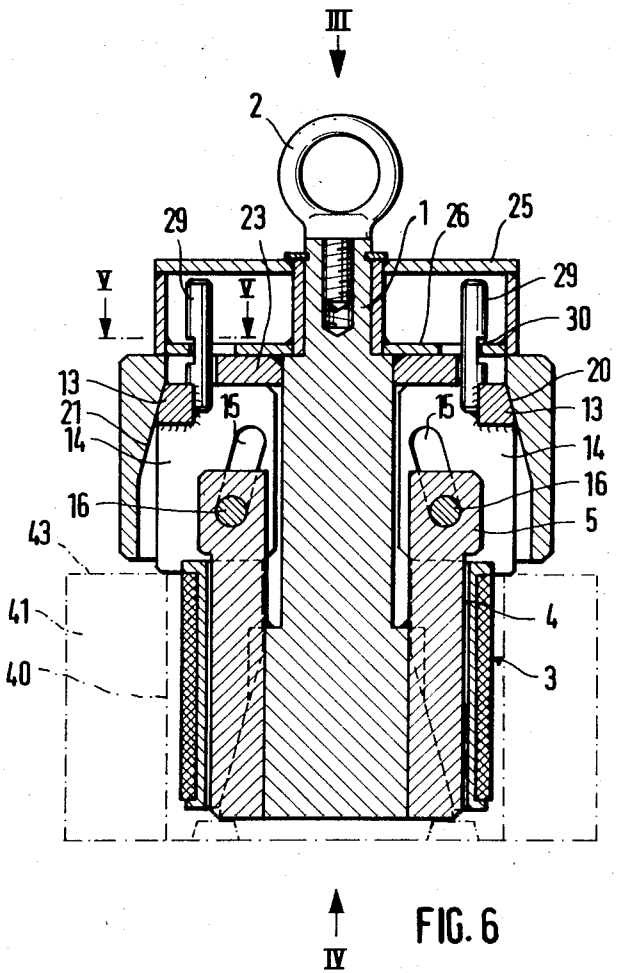
FIG. 6 is a vertical sectional view through the apparatus in its position according to FIG. 1.

The bell-shaped top 22 is fastened to the carrying bolt in the area of its upper end. Above the cover plate 23 of the bell-shaped top 22, a rotation hood 25 is mounted rotatably but is axially stable on the socket 24 of the carrying bolt 1. The bottom 26 of the rotation hood 25 has openings 27 spaced at an angular distance of 120° from each other and which has a locking part 28. A pin 29 is fastened to the crossbar 20 of each clamping segment 3 and extends into the opening 27, the pin having a notch 30 at its circumference. As can be seen in FIG. 6 which shows the pushed-in position of the clamping segments 3, the notch 30 is located at such a height that it is aligned with the bottom 26 of the rotation hood 25. The rotation hood 25 has a lateral handle 31 by means of which it can be rotated by an angle of approximately 30°. This angle results from the position of the stops 32 and 33 limiting the window opening 27 with respect to the pin 29. If the pin 29 lies, as can be seen in FIG. 5, adjacent to the stop 32, the locking bar 28 of the bottom 26 of the rotation hood 25 engages into the notch 30 of the pin 29 which is fastened to the clamping segment 3. If the rotation hood 25 is rotated with respect to the socket 24 of the carrying bolt 1 so that the locking bar 28 exits from the notch 30 of the individual pins 29, the pins 29 and thus the carrier 9 of the clamping segments 3 are released so that they can drop into the position shown in FIG. 7. The cone 20 of the crossbar 13 slides onto the inner cone 21 of the bell-shaped top 22 and the inner cone 17 of the carrier 9 onto the outer cone 8 of the carrying bolt 1. The maximum axial length of this movement is determined by the axial length of the oblong apertures 15. The carrier 9 of the clamping segments 3 has a circular clamping jaw 35 below the head 14 and has an outer friction covering 36, for example, of hard rubber or the like.

Figure 9:
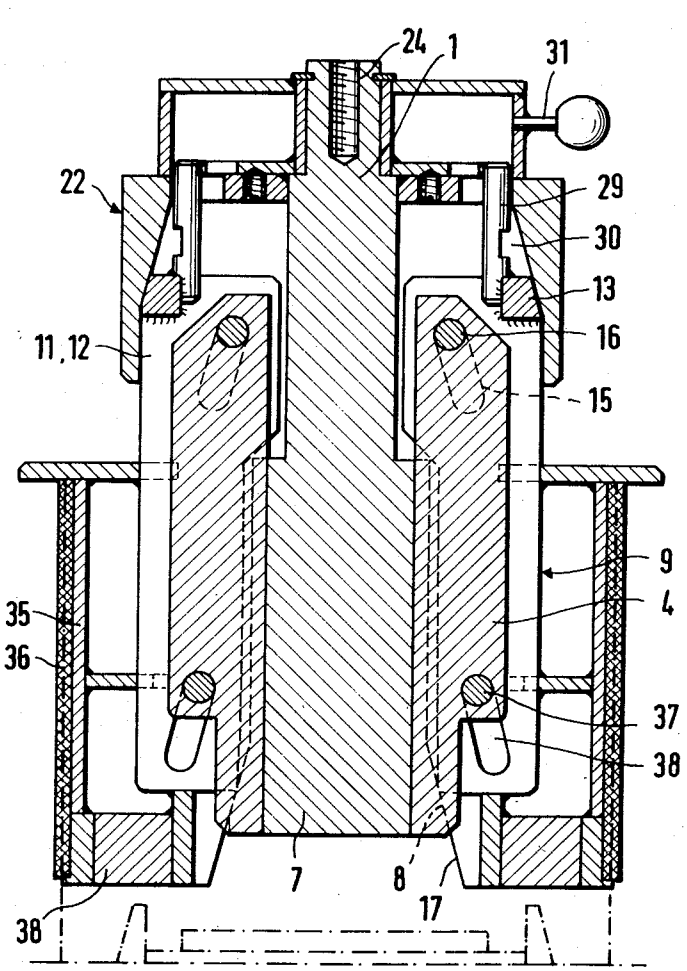
FIG. 9 is a view similar to FIG. 8 showing the expansion segments extended.
Figure 8:
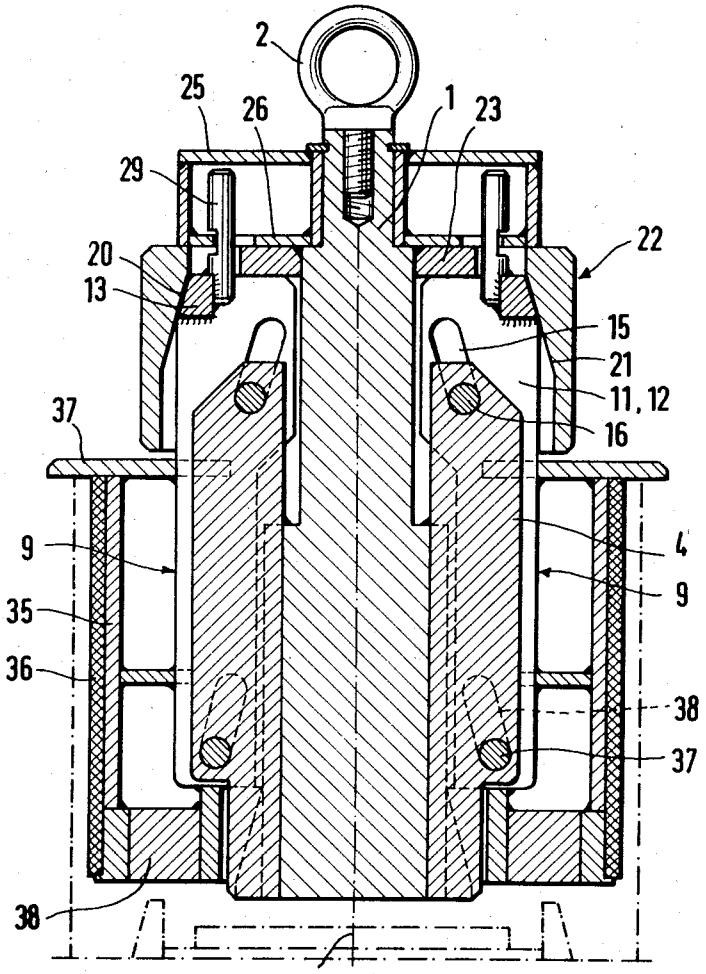
FIG. 8 is a vertical sectional view of a different embodiment of the invention showing the expansion segments withdrawn.

The embodiment according to FIGS. 8 and 9 differs from the previous embodiment in that each guide track 4 of the carrying bolt 1 has a lower crossbolt 37, besides the upper crossbolt 16, extending into an additional oblong aperture 38 in the two parts 11 and 12 of the carrier 9 of the clamping segment 3. Furthermore, the clamping jaws 35 with the friction covering 36 are connected with the carrier 9 via the intermediate parts 37 and 38.

FIGS. 1, 6 and 8 show the apparatus in a position with the clamping segments 3 pushed in. In this position, the pins 29 are locked in their upper position by the locking bars 28 in the bottom of the rotation hood 25. The clamping segments 3 are located on the minimal circumferential circle. In this position, the apparatus is pushed into the interior opening 40 of a coil 41 until the part 42 of the head 14 of the carrier 9 arrives at the upper surface 43 of the coil 41. In this position, the locking device for the pins 29 is released. Thus the rotation hood 25 is rotated by the handle 31 until the locking bars 28 release the pins 29. By their own weight, the clamping segments 3 drop until their friction covering 36 reaches the interior wall of the coil 40. If the apparatus is lifted by a lifting apparatus engaging the supporting loop 2, the clamping segments remain in their lower position and the crossbolts 16 move within the transversely extending oblong apertures 15 in an upward direction. Thus, the clamping segments 3 are moved additionally in an outward direction on their conical guides and the momentum of the friction coverings 36 increased at the coil 40 so that this is reliably brought along during the continued lifting of the apparatus.

The extent of the expansion movement of the clamping segments 3 results from the axial length of the oblong apertures 15 and the angle around which the longitudinal axis of these oblong apertures 15 converge with respect to the axis of the apparatus.

What I claim is:

1. Apparatus for the lifting of coils, spools and the like of the type which has an interior opening, the apparatus comprising a carrying shaft, guide track means arranged circumferentially about said carrying shaft, clamping segments disposed on said guide track means for movement in a radial and a longitudinal direction, said clamping segments and said guide track means having a cooperable aperture and a cross shaft accommodated in the aperture such that the cross shaft moves in the aperture during relative movement between the guide track means and the clamping segments, said carrying shaft having an outer conical surface, said clamping segments having an inner conical surface engaging said outer conical surface on said carrying shaft, and a locking means operable to lock said clamping segments into a radially inwardly disposed position such that when the locking means is released, said clamping segments are extended radially outwardly relative to said carrying shaft as said inner conical surface of said carrying segments slide on said outer conical surface of said carrying shaft to thereby engage said interior opening, said clamping segments having an upper head section, a bell-shaped means on the carrying shaft and disposed about said head section, said bell-shaped means having an inner conical surface engaging an outer conical surface on said head section, said outer conical surface on said head section sliding on said inner conical surface on said bell-shaped means when said clamping segments are moved relative to said carrying shaft.

2. Apparatus according to claim 1, wherein said locking means comprises a pin extending from said head section, said bell-shaped means having an opening receiving said pin, a locking bar means disposed on said bell-shaped means, said pin having a notch engaging said locking bar means to thereby lock said clamping segments in their radially inwardly disposed position.

3. Apparatus according to claim 2, wherein said bell-shaped means comprises a cover plate and a cylindrical part depending from said cover plate, said bell-shaped means further comprising a rotation hood rotatably mounted but axially stable on said carrying shaft, said locking bar means being rotatable with said rotation hood.

4. Apparatus according to claim 1, wherein said clamping segments comprise exterior friction surfaces for frictionably engaging said interior opening, said upper head sections of said clamping segments extending radially outwardly relative to said exterior friction surfaces.

5. Apparatus according to claim 1, wherein each clamping segment and associated guide track means have two sets of cooperable apertures and cross shafts.

6. Apparatus according to claim 1, wherein said outer conical surface on said carrying shaft is disposed at the lower end portion of said carrying shaft.

* * * * *